US006232887B1

(12) United States Patent
Carson

(10) Patent No.: US 6,232,887 B1
(45) Date of Patent: May 15, 2001

(54) WARNING SYSTEMS

(76) Inventor: Joseph E. Carson, 1305 Robert Dr., Mount Propsect, IL (US) 60056

( * ) Notice: Subject to any disclaimer, the term of this patent is extended or adjusted under 35 U.S.C. 154(b) by 0 days.

(21) Appl. No.: 09/289,156

(22) Filed: Apr. 8, 1999

Related U.S. Application Data

(60) Provisional application No. 60/083,437, filed on Apr. 29, 1998.

(51) Int. Cl.[7] ..... G08G 1/16

(52) U.S. Cl. ..... 340/903; 340/433; 340/431; 340/539; 340/825.21

(58) Field of Search ..... 340/903, 433, 340/825.21, 539, 431; 246/124, 125, 121, 128, 130

(56) References Cited

U.S. PATENT DOCUMENTS

| | | | | |
|---|---|---|---|---|
| 3,740,550 | | 6/1973 | Geiger | 246/125 |
| 3,829,682 | | 8/1974 | Geiger | 246/125 |
| 3,974,991 | | 8/1976 | Geiger | 246/34 CT |
| 4,073,453 | | 2/1978 | Thomas | 246/125 |
| 4,117,454 | | 9/1978 | Fabry et al. | 340/433 |
| 4,156,232 | | 5/1979 | Blass | 340/825.21 |
| 4,307,860 | | 12/1981 | Kuhn | 246/128 |
| 4,365,777 | | 12/1982 | Gieger | 246/130 |
| 4,581,700 | | 4/1986 | Farnham et al. | 700/80 |
| 4,937,795 | * | 6/1990 | Motegi et al. | 367/93 |
| 5,200,736 | * | 4/1993 | Coombs et al. | 340/586 |
| 5,554,982 | * | 9/1996 | Shirkey et al. | 340/903 |
| 5,620,155 | | 4/1997 | Michalek | 246/121 |
| 5,699,986 | | 12/1997 | Welk | 246/125 |
| 5,727,758 | * | 3/1998 | Penza et al. | 246/124 |
| 5,735,492 | * | 4/1998 | Pace | 246/125 |
| 5,864,304 | * | 1/1999 | Gerszberg et al. | 340/903 |
| 5,924,651 | * | 7/1999 | Penza et al. | 246/124 |
| 5,952,919 | * | 9/1999 | Merrill | 340/539 |
| 5,999,091 | * | 12/1999 | Wortham | 340/431 |

* cited by examiner

*Primary Examiner*—Benjamin C. Lee
(74) *Attorney, Agent, or Firm*—Factor & Partners

(57) ABSTRACT

A warning system for warning a user of an approaching vehicle, wherein the approaching vehicle activates a signal transmitter. The system comprising at least one transmitter and at least one receiver. The transmitter includes a member for receiving the signal from a signal transmitter; and a member associated with the receiving means for transmitting at least one signal component. The receiver is positioned remotely from the transmitter and includes a member for receiving the at least one signal component, a member associated with the receiving means for processing the at least one signal component and a member associated with the processing means for alerting a user as to an approaching vehicle.

30 Claims, 2 Drawing Sheets

WARNING SYSTEMS

This application claims priority under 35 U.S.C. Section 119 of U.S. Provisional Application Ser. No. 60/083,437 filed Apr. 29, 1998.

BACKGROUND OF THE INVENTION

1. Field of the Invention

The present invention is directed to warning systems, and more particularly, to a warning system that, for example, may be used by railroad personnel to warn of oncoming traffic. The invention is not limited, however, to use by railroad personnel. Indeed, the present invention, as will be described herein has broader applications. For example, the invention may likewise be utilized by aviation personnel to direct air traffic to the appropriate gates, or, to warn of oncoming or approaching air traffic. In sum, the invention may be utilized by individuals which require or benefit from the receipt of information in remote locations for warning or other use.

2. Background Art

Railroad warning systems have long been known in the art. One conventional warning system comprises a combination flashing light and crossing gates. These lights and gates are placed along the intersection of the railroad and either a roadway or a pedestrian walkway. Thus, such systems warn oncoming traffic on the roadway and pedestrians in close proximity to the walkway, through light and audio signals, as well as by way of a physical blockade.

While such systems are generally effective for traffic and pedestrians near such roadways and walkways, they are not very useful away from such crossings. Indeed, railroad workers often perform maintenance and repair work away from and, in turn, outside the range of conventional railroad warning systems. Accordingly, the railroad workers must rely on a separate railroad worker who performs a look-out function by watching the tracks, and signaling to the other railroad workers of oncoming trains.

While a warning system based on a railroad worker watching the tracks may be operational, such a system does have several drawbacks. In part, it is possible that the worker that is performing the lookout function becomes distracted and fails to recognize an oncoming train. In addition, the worker performing the lookout function, may use his judgement as to when to warn the workers, and the improper exercise of judgement can expose the remaining workers to an increased risk of danger. Lastly, in noisy and busy areas, the lookout worker may not be able to get the attention of railroad workers to warn them. Thus, in many instances the lookout worker still exposes the other railroad workers to unacceptably high dangers.

In addition, it is often necessary to transmit to the railroad worker certain information when in the field. Currently, the information is relayed via a two way radio or via a portable telephone, which activate with a ring or other loud noise. While such systems are at times successful in relaying information to the worker in the field, it is often difficult for the worker to receive the information, or to even acknowledge that information is being sent to him. Indeed, often due to loud conditions and increased commotion and traffic, the worker may never hear the activation signal, and may never know that someone is trying to reach the worker by telephone or by two way radio. Thus, it may become necessary to send another worker to the remote site with the necessary information, which may cause time delays and which may expose the additional worker to injury at the remote site.

In other settings, such as in an airport setting, it is necessary not only to warn ground traffic control workers on the airport tarmac, but it may also be necessary to send information to such ground traffic control workers. Conventionally, the workers receive instructions by way of two-way radios, telephones or visual signaling from the control tower. Such instructions may comprise, for example, gate assignments or aircraft taxi directions for particular aircraft. Often, however, it is difficult for such workers to receive the warnings or the information due to the excessive noise, and excessively distracting conditions. As such, the user is often unable to receive the information when the information is needed. By not receiving the information in a timely manner, the overall safety and operation of the airport can be compromised.

Thus, it is an object of the invention to warn workers in remote sites of oncoming danger, such as, oncoming railroad traffic.

It is a further object of the invention to signal workers at remote sites and to transmit information to such workers.

Further objects of the invention will become apparent in light of the present disclosure and claims.

SUMMARY OF THE INVENTION

The invention comprises a warning system for warning a user of an approaching vehicle, wherein the approaching vehicle activates a signal transmitter. In particular, the system comprises at least one transmitter and at least one receiver positioned remotely from the transmitter. The receiver includes means for receiving the signal from a signal transmitter and means associated with the receiving means for transmitting at least one signal component. The receiver comprises means for receiving the at least one signal component, means associated with the receiving means for processing the at least one signal component and means associated with the processing means for alerting a user as to an approaching vehicle.

In a preferred embodiment, the transmitter is associated with the approaching vehicle. In another such embodiment, the at least one signal component transmitted by the transmitter comprises at least three signal components. The first of the at least three signal components comprising a warning signal to indicate an approaching vehicle. The second of the at least three signal components comprising an informational signal having information pertaining to at least one of the following:

direction of the vehicle, speed of the vehicle, and approach speed of the vehicle. The third of the at least three signal components comprising a ping signal, which ping signal serves to verify communication between the receiver and the transmitter.

In a preferred embodiment, the alerting means comprises at least one of a visual, an audio or a tactile alert.

In another preferred embodiment, the receiver comprises a receiver box positioned remotely from the transmitter, a pager receiver positioned remotely from the transmitter or a safety receiver system positioned remotely from the transmitter. In an embodiment, the safety receiver system further comprises at least one of a vest and a helmet. In such an embodiment, the tactile alert comprises a vibrating member positionable against a user, the visual alert comprises an alphanumeric display unit associated with the vest and the audio alert comprises means for playing a stored voice message and at least one headphone associated with the playing means and positioned within the helmet.

In another preferred embodiment, system further includes means for coordinating the transmitter and the receiver to minimize the instances of false signals.

The coordinating means comprises unique identifier associated with the at least one receiver, means associated with the transmitting means for processing the signal component to include the unique identifier of the at least one receiver prior to transmission thereof and means associated with the processing means of the receiver for analyzing the received at least one signal component to determine if the received at least one signal component was directed to the receiver. In turn, the analyzing means determines as to whether to process the at least one signal component. In such a preferred embodiment, the system further includes means for resetting the processing means of the transmitter.

In another such embodiment, the system further includes means for storing the desired unique identifier for each of the at least one receiver associated with the transmitting means. In such an embodiment, the storing means comprises an input device and a storage medium associated with the processing means and with the input device.

The invention further comprises a method for warning of an oncoming vehicle, wherein the oncoming vehicle triggers a sensor which activates a vehicle signal transmitter. The method comprises the steps of: (a) receiving the signal by a transmitter associated with the vehicle; (b) transmitting at least one signal component; (c) receiving the at least one signal component by a receiver positioned remotely from the transmitter; (d) processing the at least one signal component; and (e) alarming a user as to the oncoming vehicle, pursuant to the processed at least one signal component.

In a preferred embodiment, the step of transmitting further includes the step of transmitting at least one unique identifier along with the at least one signal component.

In such an embodiment, the method further comprises the step of analyzing the at least one unique identifier, to in turn, determine that the received at least one signal component should be processed. In another such embodiment, the step of transmitting further comprises the step of transmitting at least three signal components.

DETAILED DESCRIPTION OF THE DRAWINGS

Figure 1:
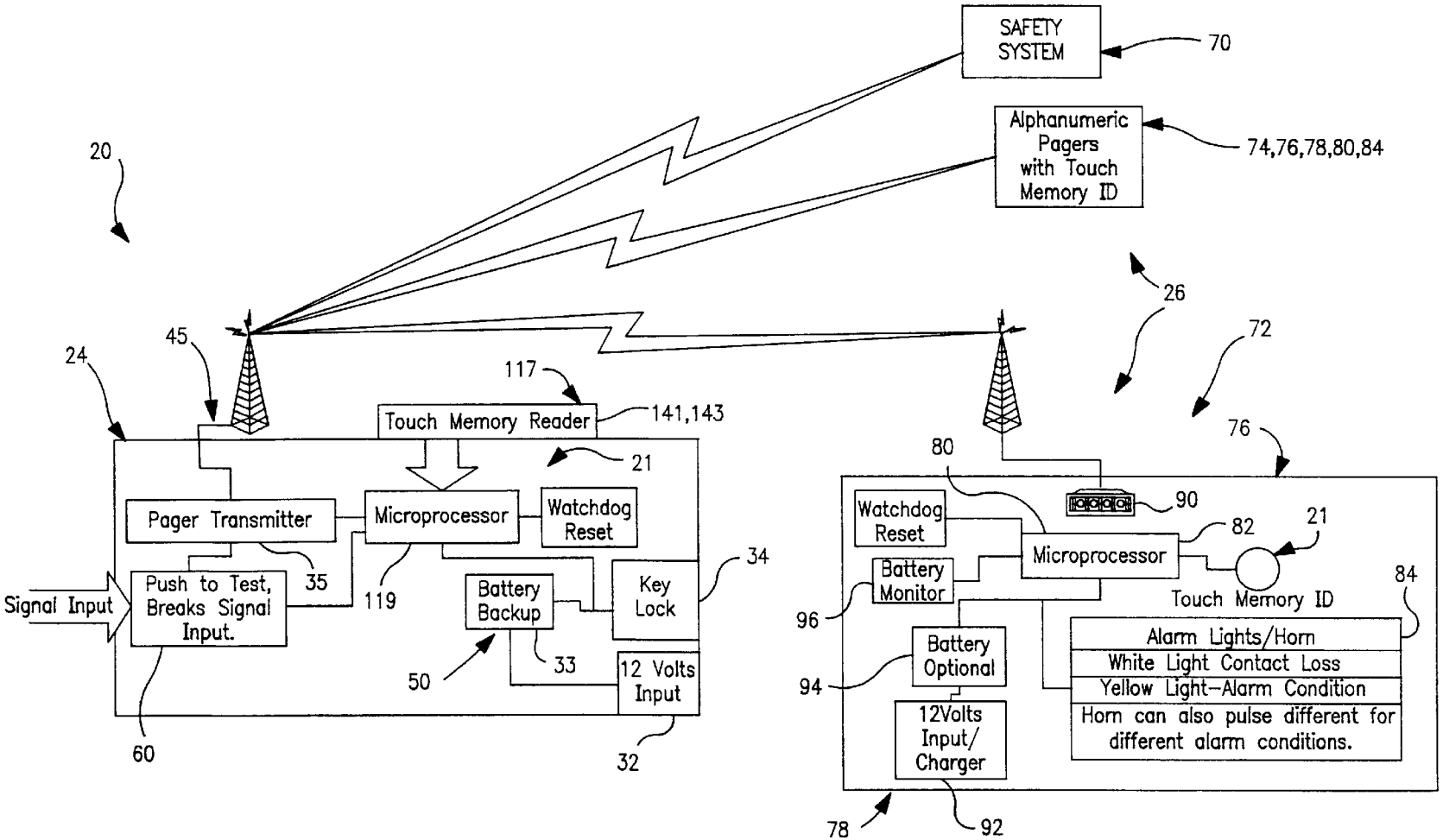
FIG. 1 of the drawings is a schematic vies of the system of the present invention.

While this invention is susceptible of embodiment in many different forms, there is shown herein in the drawings and will be described in detail several specific embodiments, with the understanding that the present disclosure is to be considered as an exemplification of the principles of the invention and is not intended to limit the invention to the embodiments illustrated.

Warning system 20 is shown in FIG. 1 as comprising transmitter 24 at least one receiver 26 and means for coordinating the transmitter and the receiver. Generally, transmitter 24 is associated with the track (such as with a railroad signal bungalow) or with a vehicle, and receiver 26 is associated with a individual and/or a worker working near or in the path of the vehicle. The vehicle generally travels along a substantially predetermined path and is capable of triggering a sensor which actuates a vehicle signal transmitter. Such a sensor may comprise a sensor which likewise activates crossing gates. The transmitter can comprise any number of convention RF or IR transmitter, among others. The system will be described in the environment of a train warning system, with the understanding that the system is equally applicable in other environments and not limited to such an environment.

Transmitter 24 is shown in FIG. 1 as comprising means 35 for receiving a signal from the vehicle signal transmitter, means 45 for transmitting the signal, means 50 for powering the transmitter, and means 60 for testing the transmitter. The transmitter, as explained above, is positioned on the tracks in a signal bungalow or in the vehicle itself, such as in one of the locomotives or on another car of train. While not required, it is advantageous to position the transmitter where it is easily accessible by engineers and other train personnel, so that it can be selectively activated, deactivated and maintained as needed.

Signal receiving means 35 is shown in FIG. 1 as a structure for receiving the signal from the vehicle signal transmitter. Inasmuch as the vehicle signal transmitter may transmit an RF and an IR signal, among others, the receiving means comprises suitable circuitry, as will be understood by one of skill in the art, so as to receive any such signal that is sent by the vehicle signal transmitter. It will be understood that the range of the signal receiving means is such that the receiving means can readily receive a suitably strong signal from the signal transmitter. Of course, certain boosters and additional powered antennas can be used to expand the range of the receiver. In addition, the signal receiving means may be hardwired to the vehicle signal transmitter (such an arrangement in preferable wherein the signal receiving means is positioned outside of the vehicle, i.e. in a signal bungalo).

Transmitting means 45 of the transmitter 24 is shown in FIG. 1 as comprising a suitable transmitter capable of transmitting at least one RF signal or other type of signal over a desired range. Of course, depending on the type of signal, the transmitting means may be required to transmit over greater or shorter distances. In the case of RF signals, the transmitter may be associated with an antenna. While many different signal ranges are contemplated, it is preferable that the transmitting means have a range that is at least two miles. It is contemplated that the range of the transmitter can be adjusted for particular applications or for particular conditions. While the transmitter can be placed in any number of locations, it is desirable to position the transmitting means within or on the vehicle so as to minimize interference and so as to maximize the range of transmission. For example, when the signal being transmitted comprises an RF signal, an antenna may be placed on top of the signal bungalo away from potential interference. Where the transmitter is in the vehicle, the antenna may be placed on top of the locomotive or the train.

Testing means 60 is shown in FIG. 1 as comprising a circuitry which is capable of disconnecting the receiving means and instead forcing a signal directly to the transmitting means for the transmission of same to the receivers. As will be explained, by sending such a test signal, the operators can determine if the transmitter, and in turn, the entire system is operating properly.

Transmitter 24 is powered by electrical powering means 50. Powering means, as shown in FIG. 1, comprises primary supply 32, back-up supply 33 and switch 34. Primary supply 32 generally comprises a 12 volt DC source which may be generated by the vehicle, or may comprise a suitable battery. Back-up supply 33 may comprise a suitable auxiliary source, such as an additional battery. In operation, with the appropriate circuitry, the back-up supply 33 is only activated if and when an interruption occurs in the primary supply. At other times, the back-up supply does not provide power to the transmitter. Moreover, it is preferable that the primary supply provide power, on a selective basis, to the back-up supply so as to maintain the back-up supply in a fully charged condition. Thus, if needed, the back-up supply will be ready to power the transmitter. Of course, other supplies, including supplies of greater or lesser voltage in either AC or DC supply are likewise considered for use.

The power from the primary and back-up supplies to the transmitter is controlled by switch 34 which can be directed into either one of an on and an off position. While other configurations are contemplated, the switch comprises a keyed lock switch. Such a keyed lock switch serves to prevent the inadvertent turning off of the system by an operator. Indeed, to turn the system on or off, the operator will require the appropriate key. Of course, other types of switches are likewise contemplated, including switches which may or may not have additional safeguards to prevent inadvertent turning off of the system.

Figure 2:
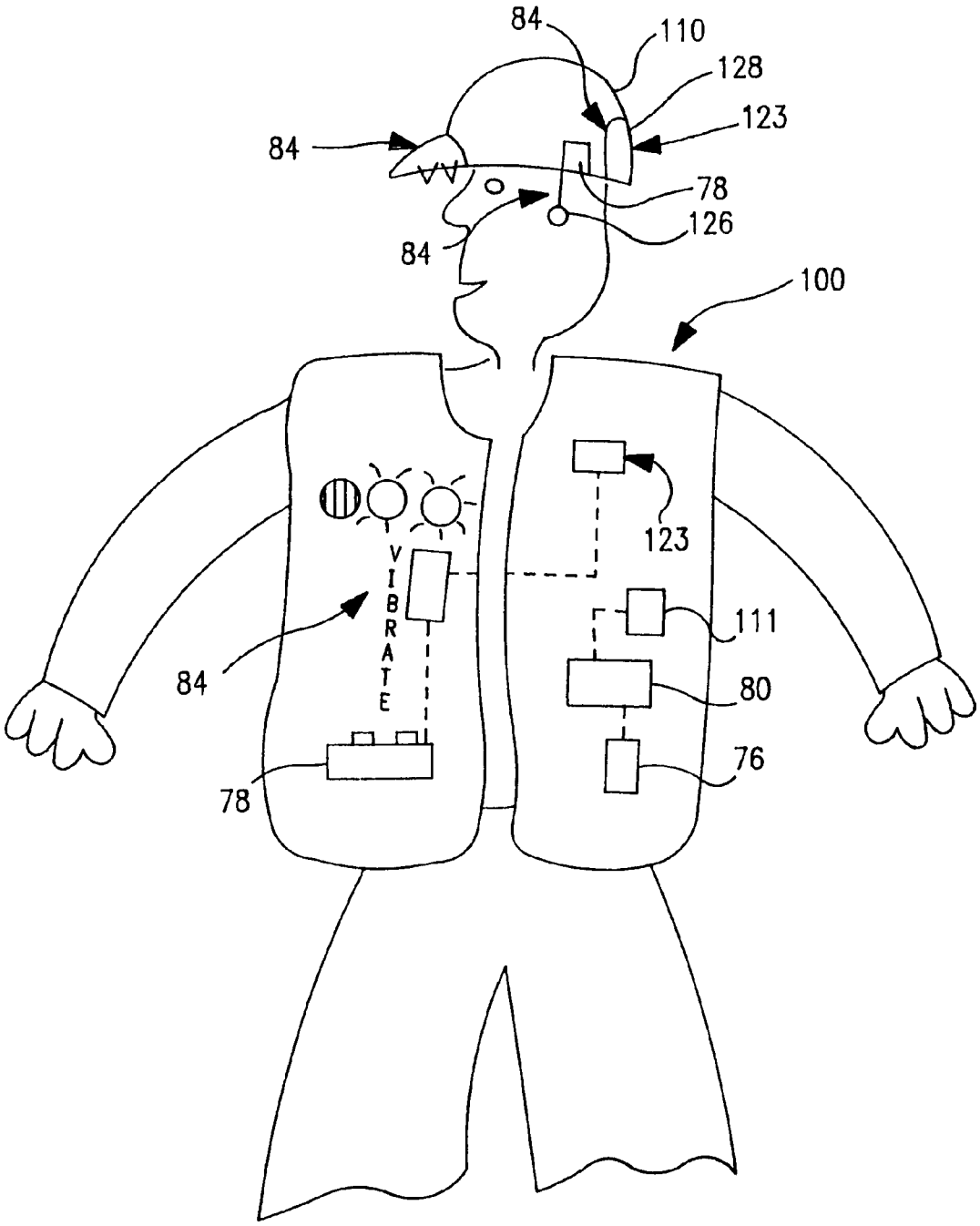
FIG. 2 of the drawings is a front view of the safety receiver system of the present invention.

The at least one receiver 26 comprises any one of a number of different receivers, such as receiver box 72 (FIG. 1), pager receiver 74 (FIG. 1) and safety receiver system 70 (FIG. 2). Of course, any quantity of and combination of these systems may be utilized. For example, several workers may utilize pager receivers, such as pager receiver 74 whereas other may utilize safety receiver systems, such as safety receiver system 70.

Receiver box 72, as shown in FIG. 1, includes means 76 for receiving the transmission from the transmitting means of transmitter 24, means 78 for electrically powering the receiver box, means 80 for processing the signal that is received by the receiving means and means 84 for alerting the user. The receiver box may comprise a device which is sized so as to be portable, and easily carried by user. The physical dimensions of the device are only limited by the individual size of the various components.

The receiving means comprises receiver 90 which is capable of receiving the signal transmitted by the transmitting means of transmitter 24. The receiver may include various antenna structures so as to extend the range at which the receiver can receive signals. Processing means 82 may comprise a microprocessor which is capable of receiving information from receiving means 76. Once received, the information is processed and a suitable output is sent to the signaling means so as to alert the user. The processing means further includes means for resetting the processing means should the processing means freeze or become hung.

User alerting means 84 may comprise any one of a variety of alerting members. For example, user alerting means 84 may comprise a visual signal or an audio signal, among other type of alerting means. In particular, in the embodiment shown in FIG. 1 (and as will be explained in more detail with respect to the operation of the device) the alerting means may comprise multiple different audio and visual signals to identify different alarm conditions. For example, a white light may signal loss of contact with the transmitter, whereas yellow light may signal an alarm condition. In addition a horn, or other audible means, may include different tones or patterns to identify a different alarm condition.

Electrical powering means 78 may comprise outside power source 92, internal power source 94 and monitor 96. Outside power source 92 may comprise a 12 volt charger or 12 volt DC input. Internal power source 94 may comprise an optional internal battery which is capable of providing power to the receiver box. Battery monitor 96 is associated with each of the outside power source 94 and internal power source 94 and identifies the condition of the power source. For example, battery monitor 96 may indicate a "low battery" or "charging" condition, as well as which of the internal or outside power sources are currently supplying power to the receiver box. As with the transmitter, various power sources, including AC & DC sources operating at varying voltages and cycles (for AC) are contemplated for use.

Another receiver 26 comprises pager receiver 74 which is shown in FIG. 1 as comprising similar means as receiver box 72. In particular, pager 74 likewise includes means 76 for receiving the signal from the transmitting means of transmitter 24, means 78 for electrically powering the pager, means 80 for processing the signal and means 84 for alerting the user. In such an embodiment, the receiving means may comprise an appropriate circuitry, which will be understood to one of skill in the art. In one embodiment, this may comprise conventional pager circuitry. The electric power means may comprise batteries such as, for example, suitable AA or AAA type batteries. Of course, other sources are likewise contemplated for use. The processing means may comprise a suitable microprocessor capable of receiving the signal and processing the signal so as to appropriately direct the alerting means. For example, the alerting means may comprise an alphanumeric LCD screen, or other visual indicators. In addition, the pager receiver alerting means may include audible alerting signal. Moreover, the pager receiver may additionally include a vibrating or other tactile alerting means, as well. In addition, a combination of all three alerting means may be used in certain embodiments.

Another receiver 26 comprises safety system 70 includes vest 100 and helmet 110, as shown in FIG. 4. At least one of helmet 110 and vest 100 includes means 76 for receiving the transmitted signal, means 78 for electrically powering vest 100 and helmet 110, means 80 for processing the signal and means 84 for alerting the user. As with other receivers 26, receiving means 76 comprises appropriate circuitry which is capable of receiving the signal sent by the receiving means. Similarly, electrical power means 78 comprises a suitable DC source, such as one or more rechargeable or replaceable battery packs in one or each of the helmet and vest. Such a battery may deliver between 1.5 and 12 v, however, other voltages are likewise contemplated. Processing means 80 comprises a suitable microprocessor which receives the signals from the receiving means and processes the information to provide an output to the alerting means.

Helmet 110, as shown in FIG. 1, includes various alerting means 84, and means 123 for communicating with vest 100. In such an embodiment, only a portion of the alerting means and means for powering the helmet are included in the helmet. The remaining structures that perform the above-identified functions are positioned and associated with vest 100. The vest and the helmet can communicate through communicating means 123, and the vest includes control panel 111 to control the operation of the vest and helmet.

Thus, with respect to helmet 100, through communicating means 123, processor means 80 of vest 100 directs the alerting means to alert the user when the appropriate signal is received by the receiving means. The various signaling means may comprise visual warnings, such as LED's or lights on the brim of the helmet, as well as certain audio warnings. In one embodiment, the helmet may include headset 126 which is associated with means 128 for storing prerecorded audio messages. In particular, storage means may comprise a voice playback IC, a minidisc, a CD-rom or other type of device capable of storing audio messages. As will be explained with respect to the operation, when directed by the processing means, storage means 128 will playback a predetermined audio message to the user through the headphones. As such, the user will hear an audio message which corresponds to a desired warning message.

With respect to vest 100, the alerting means may comprise any number of audio, visual and tactile signals to warn the user. As explained with respect to other embodiments, the processing means directs the appropriate alerting means so that the proper signal is sent to the user as to the impending danger.

The operation of the vehicle warning system will be discussed with respect to its operation in a railroad environment with the understanding that the invention has utility and applicability in other environments as well, such as an airport, for example. Certain of these environments will likewise be identified below.

In a railroad environment, rail yard workers often repair tracks at a distance away from the nearest crossing gate or conventional warning device. With the above-identified system, the rail yard worker is nevertheless warned of oncoming train traffic in time to clear a safe distance from the train track to allow the train to pass.

In such an environment, the signal bungalo, or in come embodiments, a train (locomotive or other car), is equipped with transmitter 24. As the train passes a sensor along the rails a vehicle signal transmitter associated with the sensor is triggered. Once triggered the signal transmitter begins to transmit a unique signal or set of signals. The sensor and the vehicle signal transmitter can be incorporated into the warning structures which are associated with conventional crossing gates. Additionally, the sensor may comprise any number of radio, IR, optical, mechanical, electrical or other devices which can be triggered or activated by the passing of a train along the tracks.

The signal that processing means directs to the transmitting means may comprise a first signal component which indicates that a train is approaching, a second signal component which may indicate the direction, track, speed, other parameters of the train or other information regarding the train, and a third signal component which is a signal that allows the user to know that the device is operational. The third signal component may comprise a pinging signal which, at predetermined intervals emits a ping. The ping signal at the predetermined intervals, as will be explained below, indicates to the receivers that the receiver is within range and capable of receiving the information. Presently, information which the processing means would utilize to generate the second signal component, is not generally available, however the system is prepared to handle and process such information for use in signal processing when the generation and receipt of such information is utilized. In addition, inasmuch as the system includes inputs which indicate the condition of the crossover, the transmitting means may include a signal component that indicates the condition of the crossovers.

The signal transmitted by the signal transmitter is received by receiving means 35 of transmitter 24. The receiving means is configured so as to be capable of receiving a multitude of signal components from various signal transmitters. In addition, multiple receiving means 35 may be utilized so as to be capable of receiving virtually any number of signals from a multitude of signal transmitters.

The receiving means 35 receives the information and passes the information to one of transmitting means 45. Indeed, in one embodiment, the receiving means and the transmitting means may comprise a single integrated unit. The transmitting means then transmits the received signal to receivers.

The signal transmission to the receivers may be accomplished by the use of frequency modulated radio signals (RF) or other signals such as IR to the receiving means. In one embodiment, conventional paging process (POCSAG) over RF can be utilized to transmit signals to receivers 26.

Prior to the transmission of signals, transmitting means 45 verifies that no other signals are being transmitted on the desired frequency (in the case of a frequency modulated signal). If other signals are being transmitted, then the transmitting means 45 will wait until the desired frequency is clear of other transmissions. By doing so, the system can minimize false alarms and further insure that the signals are safely transmitted to the receivers. Of course, in some systems, a multitude of frequencies can be available for use by both the transmitting means and the receivers, and the transmitting means can scan these frequencies until a desired open frequency is found.

Receivers 26 constantly monitor the airwaves for signals. Thus, once transmitted, receivers 26 are capable of receiving the transmitted signals. In the embodiment wherein the receiver box is used, the receiving means of the receiver box receives the signal and sends the signal to processing means 78. In turn, based on the signal received, the alerting means is directed to alert the railroad worker. For example, the receipt of the first signal component by the receiving means triggers the alerting means to actuate a yellow light. The yellow light indicates to the railroad worker using the receiver box that a train is approaching and has triggered the sensor. In addition, where a second signal component is likewise received by the receiver box, the alerting means is triggered to emit an audible set of tones which indicate to the worker the speed, track and distance, for example, of the oncoming train. For example, wherein the first signal component is received for an extended period of time (which indicates a slow moving or stopped train proximate the sensor) the alerting means may provide an indication of such a condition by activating a special series of audio, visual and/or tactile signals. As such, the user is alerted to such a condition. Of course, other conditions can likewise prompt the alerting means to trigger different audible, visual and tactile signals. As a result, and depending on the number of signal components, the user may be alerted as to an oncoming train, and may be provided additional informational parameters of the oncoming train. In addition, it will be understood that the alerting means may comprise any number of visual, audible and tactile signals.

As explained above, receiver 26 likewise receives the third signal component, such as the ping signal. The ping signal merely confirms that signals are being received from transmitter 24 and that the system is operational. Such a ping can be transmitted at a predetermined rate, such as a ping every 30 seconds, for example. Thus, in the event that the ping signal is not received by the receiver at the 30 second intervals, alerting means is directed by the processing means to, for example, activate a blue strobe light and an audible warning signal (as well as any other audio, visual or tactile signal), alerting the user that the communication between the receiver box and the transmitter has been lost. Once communication is restored, and the ping signal is again received, the alerting means will respond appropriately by deactivating the blue strobe light and the audible signal. It is contemplated that the suer may be able to manually turn off the audible sound, while the blue strobe will continue to function until the ping signal is restored.

Pager receiver 74 may likewise receive various signal components from transmitter 24. The pager receiver may provide various alerting means to the user, depending on the signal that is received. For example, a vibrating signal can be activated by the alerting means. When the user feels the vibration, he is alerted as to the oncoming train. In addition, an alphanumeric display can provide a message confirming the approach of a train.

The pager receiver likewise receives the third signal which confirms that the system is operational and that the pager receiver is within range. Wherein the third signal is not received by the pager, the alerting means is directed to signal to the worker that communication with the transmitter has been lost. In such a situation, the alerting means may trigger a vibrating mode, activate certain lights and provide a particular alphanumeric message to alert the worker that the communication has been lost. Once restored, the alerting means will alert the user that the communication with the transmitter has once again been restored, by ceasing to vibrate and by displaying an appropriate message on the alphanumeric display.

Safety receiving system 70 likewise includes means associated with vest 100 for receiving signals from transmitter 24. For example, once the first signal component and/or the second signal component is received, the processing means processes the signal and directs the alerting means to provide one or more of the tactile, visual and audio signals to alert the user of the oncoming train. As an example, vest 100 may include vibrating portions, which when activated by the alerting means, vibrate against the user. In addition, the vest may include speakers or horns which are likewise activated by the alerting means once a predetermined signal component is received from transmitter 24. In addition, the vest may include an alphanumeric display which can display various messages to the user. The particular messages that are displayed at any time will depend on the condition and the contents of the received signal component. As will be understood, user is prompted to look at the display by the other audio, tactile and visual signaling means.

Further, vest 100, through the communication means 123 likewise activates the alerting means of helmet 110. In particular, the bill section of helmet 110 includes visual alerting structures such as LED's or other lights which alert the worker. In addition, helmet 110 further includes means which can playback a prerecorded message through headphones 126 associated with the helmet. As such, the user, in addition to the various other audio, visual and tactile signals, also receives a separate audio signal in the form of a prerecorded message. Indeed, based on the types of signal components received, the processing means can select from a multitude of prerecorded messages from storage means of the helmet 110.

Vest 100 includes control panel which facilitates the user's control of the vest and the helmet. In addition, it is contemplated that the vest can be used without the helmet described above, but rather with a conventional helmet. In addition, the helmet may comprise a self-contained unit which includes means for receiving the transmitted signal and means for processing the signal. Thus, in such an embodiment, the helmet can be used independently of the vest.

All three types of receivers include means for alerting the user of a loss of power.

For example, the alerting means likewise includes provisions to alert the worker of a "low battery" or "loss of power" signal. Thus, the user will be able to replace the batteries, or provide an alternate powering means for the receiver. As such, this system minimizes the possibility that the user will be incorrectly relying on a receiver that is not operational.

In certain embodiments, the system further includes means 21 for coordinating the transmitter with the particular receivers that are utilized. Thus, the transmitters of the system can send signals wherein the receivers can determine as to whether the signal is intended for that particular receiver. In particular, the coordinating means may further include means 117 for storing the unique identifiers. The storing means may comprise means 141 for inputting the unique identifiers and storage medium 143 in which to store the input identifiers for later use by processing means 119 of transmitter 24. The processing means further includes means for resetting the processor should the processor freeze or become hung. In operation, in such an embodiment, the processing means of the transmitter receives the signal from the track signal transmitter and the coordinating means appends to the signal a unique identifier of each of the receivers that are in use. The unique identifiers of each of the receivers can be input into the transmitter by way of input means 1141 which may comprise any one of a bar code scanner, an OCR scanner, a keyboard, tablet, mouse, touch screen, or other conventionally used input device. Subsequently, this entire signal is sent. The receivers receive the signal, and, through processing means determine if the unique identifier of the signal corresponds to the pagers unique identifier. The unique identifier of the receiver may be maintained in memory associated with the processor. Such memory may comprise either RAM or ROM. If the unique identifiers correspond, then the remainder of the signal is processed. If however, the signals do not correspond that the remainder of the signal is ignored. In this manner, only those signals that are directed to the particular receiver are processed by that receiver. This minimizes the chances for the receiver to receive incorrect or inappropriate messages.

Again, as stated above, the system is equally applicable in other environments, such as at an airport. Moreover, the uses of the system to properly warn and to properly send information to workers and users at remote locations are quite broad, and may be utilized in varying environments.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A warning system for warning a user of an approaching vehicle, wherein the approaching vehicle activates a signal transmitter, the system comprising:

a single transmitter including means for receiving the signal from a signal transmitter; and means associated with the receiving means for transmitting at least one signal component;

wherein the single transmitter is associated with an existing warning structure and the signal transmitter comprises a signal transmitter associated with an existing warning structure, and at least one receiver positioned remotely from the transmitter including means for receiving the at least one signal component;

means associated with the receiving means for processing the at least one signal component; and means associated with the processing means for alerting a user as to an approaching vehicle.

2. The warning system according to claim 1 wherein the at least one signal component transmitted by the transmitter comprises at least two signal components.

3. The warning system according to claim 2 wherein the one of the at least two signal components comprises a ping signal, which ping signal serves to verify communication between the receiver and the transmitter.

4. The warning system according to claim 1 wherein the at least one signal component transmitted by the transmitter comprises at least three signal components, the first of the at least three signal components comprising a warning signal to indicate an approaching vehicle;

the second of the at least three signal components comprising an informational signal having information pertaining to at least one of the following: direction of the vehicle, speed of the vehicle, and approach speed of the vehicle; and the third of the at least three signal components comprising a ping signal, which ping signal serves to verify communication between the receiver and the transmitter.

5. The warning system according to claim 1 wherein the receiver comprises a receiver box positioned remotely from the transmitter.

6. The warning system according to claim 1 wherein the alerting means comprises at least one of a visual, an audio or a tactile alert.

7. The warning system according to claim 1 wherein the receiver comprises a pager receiver positioned remotely from the transmitter.

8. The warning system according to claim 1 wherein the receiver comprises a safety receiver system positioned remotely from the transmitter.

9. The warning system according to claim 8 wherein the safety receiver system further comprises at least one of a vest and a helmet.

10. The warning system according to claim 9 wherein the alerting means comprises at least one of visual, audio or tactile alert.

11. The warning system according to claim 10 wherein the tactile alert comprises a vibrating member positionable against a user.

12. The warning system according to claim 10 wherein the visual alert comprises an alphanumeric display unit associated with the vest.

13. The warning system according to claim 10 wherein the audio alert comprises:

means for playing a stored voice message;

at least one headphone associated with the playing means and positioned within the helmet.

14. The warning system according to claim 1 further comprising means for coordinating the transmitter and the receiver to minimize the instances of false signals, wherein the coordinating means comprises:

a unique identifier associated with the at least one receiver;

means associated with the transmitting means for processing the signal component to include the unique identifier of the at least one receiver prior to transmission thereof; and means associated with the processing means of the receiver for analyzing the received at least one signal component to determine if the received at least one signal component was directed to the receiver, to in turn, determine as to whether to process the at least one signal component.

15. The warning system according to claim 14 further comprising means for resetting the processing means of the transmitter.

16. The warning system according to claim 14 further comprising:

means for storing the desired unique identifier for each of the at least one receiver associated with the transmitting means.

17. The warning system according to claim 16 wherein the storing means comprises:

an input device; and a storage medium associated with the processing means and with the input device.

18. The warning system according to claim 1 further comprising means for resetting the processing means of the receiver.

19. A receiver for use in association with a vehicle warning system for warning of approaching vehicles having at least one transmitter for transmitting at least one signal component, comprising:

means for receiving the at least one signal component;

means associated with the receiving means for processing the at least one signal component;

means associated with the processing means for alerting a user as to an approaching vehicle; and a unique identifier associated with the receiver, which unique identifier is input into the transmitter of the vehicle warning system upon use in association therewith, to, in turn, facilitate the transmission by the transmitter of signals to the desired receivers, and to facilitate the maintenance by the transmitter of receivers associated therewith.

20. The receiver according to claim 19 wherein the receiver comprises a safety receiver system including:

a vest; and a helmet, wherein the alert means includes at least one audio, visual or tactile alert associated with at least one of the vest and the helmet.

21. The receiver according to claim 20 wherein the alert means comprises a tactile alert associated with the vest.

22. The receiver according to claim 20 wherein the alert means comprises a visual alert associated with a lower surface of a bill of the helmet.

23. The receiver according to claim 20 wherein the alert means comprises a visual alert comprising an alphanumeric LCD display associated with the vest.

24. The receiver according to claim 19 wherein the receiver comprises a pager receiver.

25. The receiver according to claim 24 wherein the pager receiver includes at least one of an audio, visual or tactile alert.

26. The receiver according to claim 25 wherein the tactile alert comprises a vibrating alert.

27. The receiver according to claim 25 wherein the visual alert comprises an alphanumeric LCD display.

28. A method for warning of an oncoming vehicle, wherein the oncoming vehicle triggers a sensor which activates a vehicle signal transmitter comprising the steps of:

(a) inputting a unique identifier associated with a receiver in use with the vehicle signal transmitter;

(b) repeating the step of inputting for each receiver in use with the vehicle signal transmitter;

(c) receiving the signal by a transmitter triggered by the vehicle;

(d) forming a signal component for each unique identifier associated with the receiver, each such signal component comprising a warning signal component and the unique identifier;

(e) transmitting the formed signal components;

(f) receiving the at least one signal component by each receiver positioned remotely from the transmitter;

(g) processing only the signal component having the unique identifier corresponding the unique identifier of the receiver for each receiver in use with the vehicle signal transmitter; and (h) alarming a user utilizing a receiver that has processed the signal component as to the oncoming vehicle, pursuant to the processed signal component.

29. The method according to claim 28 wherein the step of transmitting further includes the step of transmitting at least one unique identifier along with the at least one signal component, the method further comprising the step of analyzing the at least one unique identifier, to in turn, determine that the received at least one signal component should be processed.

30. The method according to claim 27 wherein the signal component comprises three signal components.

* * * * *